United States Patent [19]

Gooding

[11] Patent Number: 4,664,638

[45] Date of Patent: May 12, 1987

[54] BLACKWATER LIFESAVER

[76] Inventor: Ronald D. Gooding, 1359 Woodville Pike, Milford, Ohio 45150

[21] Appl. No.: 806,685

[22] Filed: Dec. 9, 1985

[51] Int. Cl.[4] ..... B63B 22/18

[52] U.S. Cl. ..... 441/6; 441/24

[58] Field of Search ..... 441/6–9, 441/11, 20, 21, 23, 24, 27, 80

[56] References Cited

U.S. PATENT DOCUMENTS 1,935,229 11/1933 Neal ..... 441/8

FOREIGN PATENT DOCUMENTS 1306730 9/1962 France ..... 441/6

92547 11/1968 France ..... 441/24

*Primary Examiner*—Sherman D. Basinger

[57] ABSTRACT

A safety device to locate someone in trouble in the water. A three piece apparatus consisting of a U shaped nylon body mount and a modified rectangle polypropylene floater connected by a flexible line between the floater and body mount.

1 Claim, 8 Drawing Figures

BLACKWATER LIFESAVER

CROSS-REFERENCES

The inventor is not aware of any similar invention.

BRIEF SUMMARY

The purpose of this invention is to provide a means of finding a person who is in trouble in the water, possibly drowning, and especially for dark water, (blackwater). Although it may also be a warning aid for a person in trouble in any liquid condition.

DETAILED DESCRIPTION

The piece shown in FIG. 5 through FIG. 8 is four views of one part. This is a nylon holding device for FIG. 1 through FIG. 4 to be worn on the wrist by a strap through the slot marked No. 1 in FIG. 6, the slot is all the way through FIG. 6.

Figure 4:
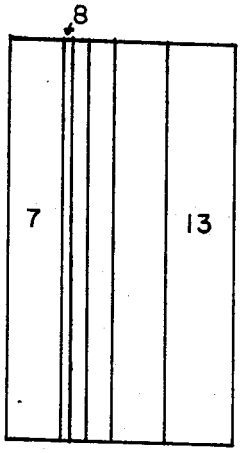
FIG. 4 is a side floater view of FIG. 2 turned 90° to the right.
Figure 6:
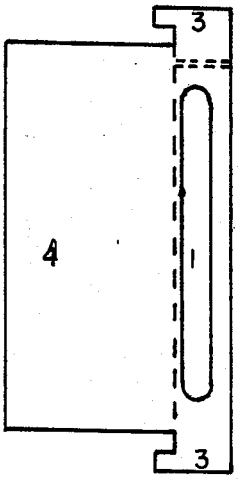
FIG. 6 is a side view of the holding device showing the wrist band slot.

FIG. 6 is a side view that corresponds to FIG. 4 the floating piece by laying the two drawings side by side.

The scale is full size on all drawings.

The raised portion marked No. 3 on FIG. 6 is a stop to keep part FIG. 4 from sliding out the end of the holder when the two are attached.

Figure 5:
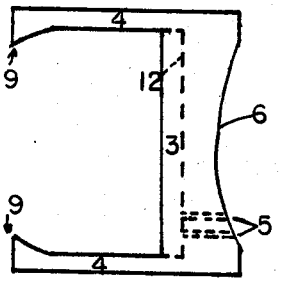
FIG. 5 is an end view of the holding device.
Figure 8:
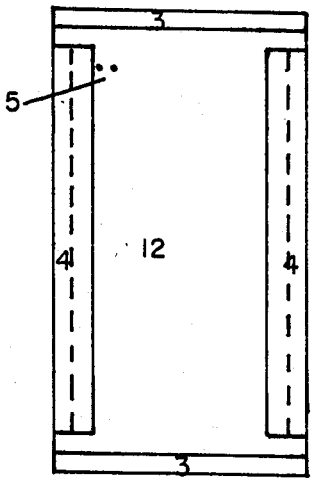
FIG. 8 is a top view of the holding device.

No. 4 of FIGS. 5, 6, and 8 is the flexible side(s) which flexes open to receive the part shown in FIGS. 1–4 to hold it in place to wear.

If we turn FIG. 6 90° to the right it becomes FIG. 8. This would be a top view by the person wearing it. We now see top views of Nos. 3 and 4 plus Nos. 5 which are two small holes 0.040 thousands in the bottom of the wrist part.

Figure 7:
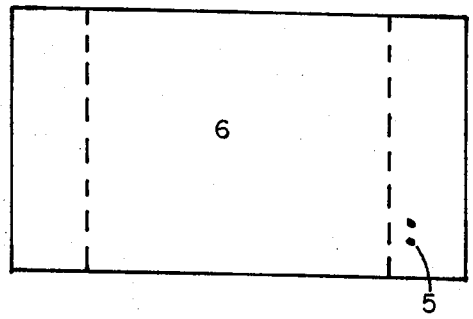
FIG. 7 is a bottom view of the holding device.

The purpose of these holes is to attach the fishing string to the wrist part by simply going through one hole to the bottom which is FIG. 7, then back through the other hole and tying a knot to itself on the inside area 12.

Now returning to FIG. 6. If we turn FIG. 6 90° this time by taking the bottom end as shown on the drawing as you are looking at it, the bottom end being the bottom of the drawing sheet, and raise the bottom end towards the top of the page it becomes FIG. 5.

Figure 3:
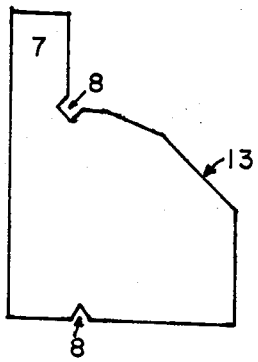
FIG. 3 is a non-cutaway end view of the floater, both ends are the same.

FIG. 5 corresponds or mates, to FIG. 3 as FIG. 4 does to FIG. 6. We now get a clearer view of area No. 4. Both 4's will flex open to receive part, FIG. 3.

The wrist holder, FIGS. 5 through 8 for this model was fabricated from a one piece block of nylon.

It was cut out on a milling machine by the inventor using various cutters to achieve the end result.

The fact it is a one piece nylon block makes area 4 a flexible area with a natural spring action that will return to original shape after flexing open.

Area 6 is concaved to make a more natural fit to a human wrist.

If we flip FIG. 5 90° to the left we have FIG. 7, shown on the drawing to the right of FIG. 5, which is the bottom view of the holder. This shows area No. 6 in complete perspective. This also shows the two string holes No. 5.

We now go to FIGS. 1 through 4. This piece is made of polypropylene which has a specific gravity of 0.900 to 0.915 which allows it to float. It like the wrist part was fabricated from one block in a milling machine by the inventor using various cutters to achieve the end result.

Starting with FIG. 3, which is an end view, we reiterate that FIG. 3 matches up to FIG. 5 by laying the drawings side by side.

Area 7 is the grasp handle the wearer would pull on to detach the floater from the wrist part.

Nos 8 are two knotches that tips No. 9 of the holder lock into to secure the floater to the wrist part.

The purpose of area 13 being milled off is to allow clearance for FIGS. 1 through 4, (the floater), to be able to be detached from FIGS. 5 through 8, (the wrist part), by a pull on area 7 which rotates the floater out of the wrist part.

By rotating FIG. 3 90° we have FIG. 4. This is done by moving the end facing you of FIG. 3 down towards the bottom of the drawing. The view of FIG. 4 is the top of the grasp handle 7.

FIG. 4 mates to FIG. 6 of the holder page.

Figure 1:
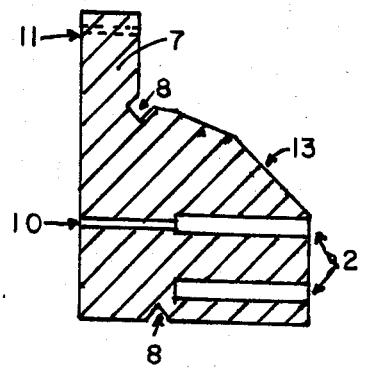
FIG. 1 is a cut-away end view of the floater.

FIG. 1 is a cutaway view of FIG. 3 from the same side. It shows area 2 the string holding cavity. Passageway No. 10 is where the string is threaded through to get to area No. 11 a hold in the grasp handle where it is tied to retain one end of the string when the floater is released. The string uncoils from the cavity No. 2 as the distance between the floater FIG. 1 through FIG. 4 and the wrist part FIG. 5 thru FIG. 8 increases caused by the sinking of the wrist part and the floater remaining on the surface.

Figure 2:
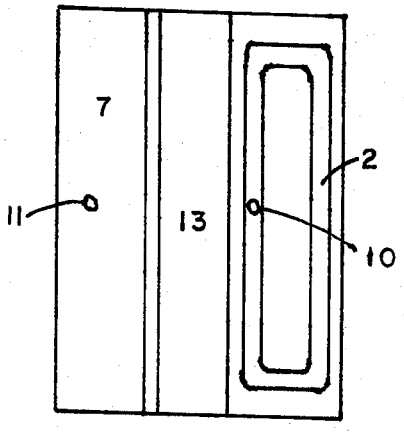
FIG. 2 is a bottom view of the floater.

FIG. 2 is accomplished by rotating FIG. 4 90° to the left. This view would be the bottom of the bottom of the floater. The bottom being the side that rests against area No. 12 when the two are attached.

Area No. 12 keeps the string in cavity No. 2 while the two parts are attached.

FIG. 2 shows the string hole No. 11 in area 7. This hole penetrates completely through area 7. The string passes thru this hole and is tied (knotted) to itself.

I claim:

1. A safety device for locating someone in trouble in a liquid, said device comprising: a one piece U-shaped holder, a one piece floating piece, and a string connecting said holder and said floating piece; said holder having a concave bottom for more natural fit on a human wrist, said holder further having upstanding members which flex open to receive said floating piece;

said floating piece having a notch on each side, each upstanding member having an inwardly extending tip, said tips mating with said notches to lock said floating piece in said U-shaped holder;

said floating piece further having a handle for grasping for removing said floating piece from said U-shaped holder for indicating when a user is in trouble, a beveled lower edge enabling said floating piece to pass by said upstanding members when it is removed from said U-shaped holder, and an endless groove forming a substantially rectangular outline in the bottom of said floating piece for storage of said string.

* * * * *